United States Patent [19]

Schultes et al.

[11] Patent Number: 4,573,487

[45] Date of Patent: Mar. 4, 1986

[54] UMBRELLA FRAME WITH SLIDER RELEASE MECHANISM

[75] Inventors: Tilmann Schultes, Solingen; Klaus Stiller, Langenfeld, both of Fed. Rep. of Germany

[73] Assignee: Kortenbach & Rauh Kommanditgesellshaft, Solingen, Fed. Rep. of Germany

[21] Appl. No.: 674,323

[22] Filed: Nov. 23, 1984

[30] Foreign Application Priority Data

Dec. 17, 1983 [DE] Fed. Rep. of Germany ..... 3345725

[51] Int. Cl.[4] ..... A45B 25/14; A45B 25/08

[52] U.S. Cl. ..... 135/24; 135/39

[58] Field of Search ..... 135/37, 38, 39, 40, 135/41, 42, 28, 24, 19.5, 20 R; 24/614, 615, 647; 70/59; 403/322, 329, 330

[56] References Cited

U.S. PATENT DOCUMENTS

| | | | |
|---|---|---|---|
| 508,189 | 11/1893 | Swan | 135/39 |
| 803,739 | 11/1905 | Bamberger et al. | 135/39 |
| 1,735,285 | 11/1929 | Kortenbach, Jr. | 135/38 |
| 4,418,707 | 12/1983 | Wu | 135/24 |

FOREIGN PATENT DOCUMENTS

| | | | |
|---|---|---|---|
| 1916932 | 6/1965 | Fed. Rep. of Germany . | |
| 1958868 | 4/1967 | Fed. Rep. of Germany | 135/39 |
| 1242813 | 6/1967 | Fed. Rep. of Germany . | |
| 2253184 | 10/1972 | Fed. Rep. of Germany | 135/24 |
| 2309223 | 2/1973 | Fed. Rep. of Germany | 135/24 |

*Primary Examiner*—Robert A. Hafer
*Assistant Examiner*—D. Neal Muir

[57] ABSTRACT

A mechanism for releasing the slider (4) of an umbrella frame, has a trigger sleeve (8), which cooperates with a locking member (6) of the slider and is axially movable in or on a handle (2) of the umbrella against spring action to move the locking member out of its locking engagement with in the slider. In order to simplify the release for clumsy or ignorant umbrella users or for foolproof operation, there is arranged on the trigger sleeve a secondary trigger which may be pressed radially inwards either manually or upon axial displacement of the trigger to move the locking member out its locking engagement with the slider.

6 Claims, 7 Drawing Figures

UMBRELLA FRAME WITH SLIDER RELEASE MECHANISM

BACKGROUND OF THE INVENTION

1. Field of the Invention

The invention relates to an umbrella frame of the kind (hereinafter to as of the kind described) comprising a stick carrying a fixed handle and a slider, which is lockable relatively to the stick by means of a locking member, the locking member being operated to release the slider by an operative axial movement relative to the stick against spring action of a trigger sleeve which is carried by the handle.

2. Description of Related Art

A mechanism which obviates the unintentional release of an unbrella slider, upon seizing the handle of the umbrella, is already known, for example, from the German Pat. No. DE-B-1242813, published June 22, 1964. In that case, the trigger sleeve, which is guided on the stick by a bush so as to movable axially in the handle of the umbrella, is held by a compression spring in the position of readiness. During the course of the operative axial movement of the sleeve against the pressure of the spring, effected by pressing in the trigger sleeve, the sleeve slides on the stick and moves the locking member out of its locking engagement with the slider. According to a further variant of this prior disclosure, the release of the locking member of the slider is effected, via a part which slides in the stick and cooperates with a wedge formed in the stick, thus forcing a locking member in the slider out of its locking engagement in the stick. In both cases, the trigger sleeve is integrated in the inner, or on the outer, edge of the umbrella handle to such a great extent that the grip area provided for the hand holding the umbrella handle remains completely free functionally, as well as optionally, of the release mechanism. The consequence of this is that users of umbrellas having release mechanisms of that kind, who, upon buying an umbrella unmindfully throw away the instructions for use, upon needing to use the umbrella, have great trouble in opening it correctly and then only after first of all turning the umbrella round and round in their hands for a long time while looking for the release trigger.

On the other hand release mechanisms in the form of push buttons for the sliders of umbrellas are already known, for example, from German utility model No. DE-GBM-1916932, published June 3, 1965, and these lie quite conspicuously within the area of grasp of the handle. These pushbuttons are attached resiliently to the umbrella handle or to the umbrella stick. The push button projects through an opening in the wall of the umbrella handle and acts upon the locking member of the slider upon being pressed in radially. Through the conspicuous placing of the push button in the surface of the handle, every user of the umbrella immediately recognizes how and where he has to release the umbrella slider when needed. However, this type of push button release has the disadvantage that it very easily becomes actuated unintentionally, e.g. upon roughly seizing the handle, and, particularly in the case of automatically opening umbrellas, may have unpleasant consequences.

There are also already release mechanisms, e.g., in accordance with German utility model No. DE-GBM 1958868, published Apr. 20, 1967, for the sliders of umbrellas in the form of slider sleeves which are arranged separately from the umbrella handle but mounted on it and are coupled directly and positively to the locking member of the slider itself. This release mechanism, is limited to umbrellas of the kind having a rigid stick which cannot be shortened, in which the necessary additional length of construction for the arrangement of the slider sleeve mounted on the handle plays no part.

SUMMARY OF THE INVENTION

An important advantage of the invention is to improve the slider release mechanism of an umbrella frame of the kind described in such a way that it may be operated more easily and above all in a foolproof manner, whilst largely retaining integration in or on the umbrella handle.

In accordance with the invention, an umbrella frame of the kind described is characterized in that the trigger sleeve carries a secondary trigger which projects at the top of the handle and which is pressable radially inwardly to operate the locking member both independently of, and by, the operative axial movement of the trigger sleeve.

In this way, a release mechanism for a slider of an umbrella is created, which can be actuated considerably more easily than the previous mechanisms of this kind, and, so to speak, in a foolproof manner. This follows from the fact that the release of the locking member of the slider may be effected both through the axial shifting of the trigger sleeve in the course of downwards pressure in parallel with the stick, and through simultaneous exertion of radial pressure upon the associated secondary trigger, and also only through radial exertion of pressure upon the latter, that is, through axial and radial pressure or only through radial pressure. These movements are converted directly from the natural reflex of the human hand without these reflexes needing a previous instruction, so that consequently even the clumsy, or functionally ignorant, umbrella user is placed in the position of actuating the release mechanism without any problem. Independently of that the grip area of the umbrella handle may remain exclusively reserved for the grip round it of the hand holding the umbrella, whereby unintentional release is avoided.

An advantageous embodiment of the invention results if the secondary trigger is a swingable segment of the trigger sleeve, the segment cooperating with, and riding radially inwardly over, an edge, which is on the handle or otherwise fixed relatively to the stick, upon the operative axial movement of the trigger sleeve.

The secondary trigger may have an inclined slide surface which engages the edge and, under its inherent resilience, urges the trigger sleeve axially to its position of readiness for the operative axial movement to operate the locking member.

The trigger sleeve may have a flared end, at which the secondary trigger projects, the secondary trigger being shaped to conform substantially with the flare.

In an alternative construction, the secondary trigger is radially slidable on the trigger sleeve and has, on one side, an inclined slide surface engaging an edge, which is on the handle or otherwise fixed relatively to the stick, and, on the other side, a surface engaging the locking member.

The trigger sleeve may be restricted in its axial movement and in its alignment by means of a projection, such as a tongue or pin, engaging in an elongate slot, one of the projection and slot being provided by the trigger sleeve and the other by the handle or stick.

BRIEF DESCRIPTION OF THE DRAWING

The invention will now be explained in greater detail with the aid of the accompanying drawings, in which.

DESCRIPTION OF PREFERRED EMBODIMENTS

Figure 1:
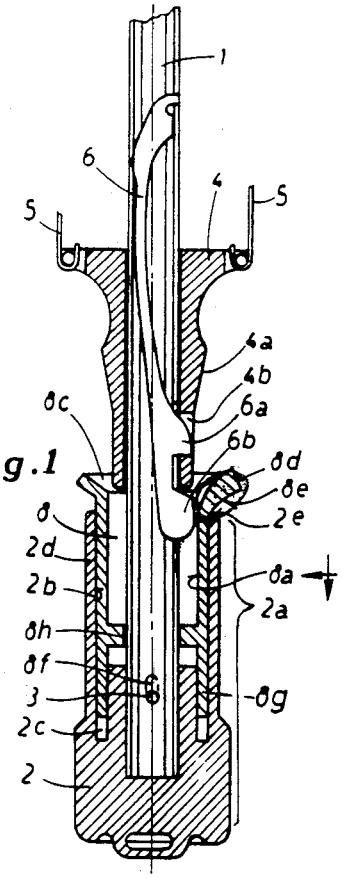
FIG. 1 is an axial section through the bottom part of an umbrella frame constructed in accordance with the invention, with the end of the stick, the handle and the slider in an initial position ready for release.

The slider release mechanism of a frame in accordance with the invention is applicable both to umbrellas of the kind which have to be opened manually and for umbrellas of the automatically opening and/or closing kind, without resriction as to whether the umbrellas are able to be shortened or not. The illustrations in the drawing are therefore restricted merely to the slider release mechanism, which is essential to the invention in the bottom part of an umbrella. To that extent the stick is shown to be hollow. If the stick 1 is part of a shortenable umbrella, the stick is subdivided into two, three or more telescopic members.

On the bottom end of the stick 1 a handle 2 is fixed immovably by means of a crosspin 3. The umbrella handle 2 is essentially hollow and has a grip area 2*a* for the hand of the user of the umbrella and a cylindrical inner wall 2*b* which in the bottom part runs out into an annular channel 2*c*. Consequently the umbrella handle, which may have any kind of external design, has a collar-like wall 2*d* with an edge 2*e*, which is preferably rounded off or bevelled.

Figure 7:
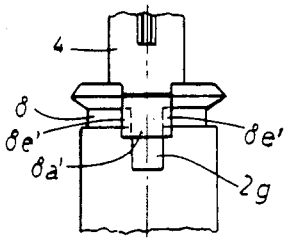
FIG. 7 is an elevation of part of the FIG. 6 frame as seen turned through 90°.
Figure 5:
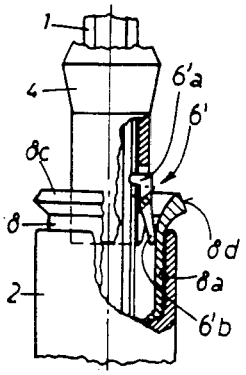
FIG. 5 is a partially sectioned elevation of the handle and slider parts of another frame.

On the umbrella stick 1 an umbrella slider 4, with a grip collar 4*a*, is axially slidable. The umbrella slider 4, to which struts 5 for canopy spokes which are not shown, are, in known manner, hinged, is locked in the closed state of the umbrella by means of a locking member 6 as may be seen from FIGS. 1 and 2. The locking member 6 is fixed in the umbrella stick 1 and two noses 6*a* and 6*b* project under inherent spring tension through corresponding openings 1*a* and 1*b* in the umbrella stick 1. The nose 6*a* engages in an opening 4*b* in the umbrella slider 4 and locks it against movement in the direction of the arrow; see FIG. 2 7. The umbrella slider 4 is released to move axially in the sense of opening the umbrella, if the nose 6*b* is pressed radially inwards into the umbrella stick 1 against the inherent spring tension of the locking member 6 until the nose 6*a* comes out of engagement with the opening 4*b* in the umbrella slider 4. This arrangement and construction of the locking member 6 is only one of many other possible variations. Thus the locking member 6 may, for example as shown in FIG. 5, be pivotally supported on the umbrella slider 4 in the form of a locking pawl 6', engage under spring action by a locking nose 6'*a* in an opening in the umbrella stick 1, and be lifted through radial actuation of a lever arm 6'*b* out of locking engagement in the umbrella stick 1.

Figure 3:
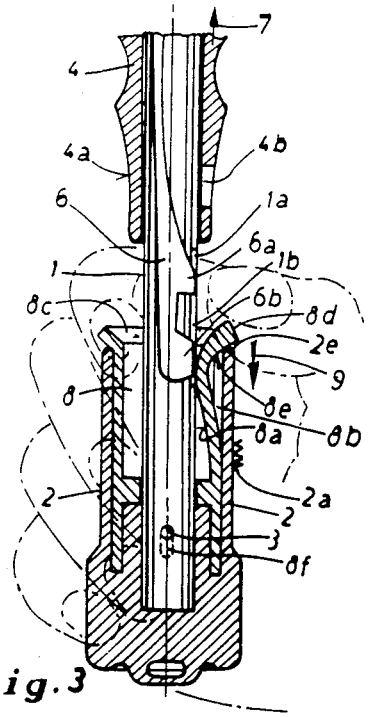
FIG. 3 is a section similar to FIG. 1, showing a user's hand in phantom lines and showing the slider released by actuation of the secondary trigger in parallel with the stick.
Figure 4:
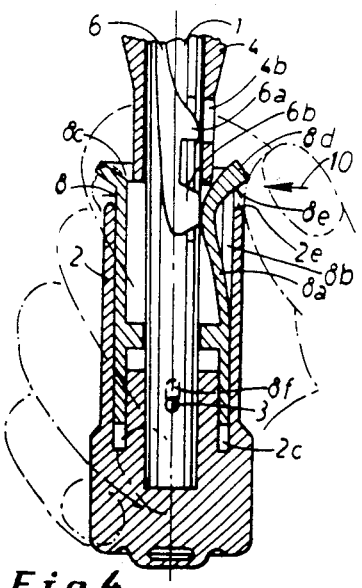
FIG. 4 is a section similar to FIG. 3 but showing the slider released by actuation of the secondary trigger radially of the stick.

The release of the umbrella slider 4, locked in one or other ways, is effected at option through a shifting in parallel with the stick of a primary trigger sleeve 8 guided in or on the umbrella handle 2 (FIG. 3) and/or through radial actuation of a springy segment 8*a* which forms a secondary trigger and which is preferably in the form of a spring tongue cut out of the wall 8*b* of the sleeve 8, or injection-moulded integrally with the sleeve (FIG. 4). The displacement of the sleeve 8 axially in parallel with, the stick is achieved by the end of the sleeve projecting out of the handle 2 of the umbrella, that is outside the grip area 2*a*, in the direction of the arrow 9 (FIG. 3), whilst the radial actuation of the secondary trigger springy segment 8*a* is effected in the direction of the arrow 10 by means of a skid 8*d* projecting in the form of a button over the edge 2*e* of the collar of the umbrella handle 2 at the top of the handle.

Figure 2:
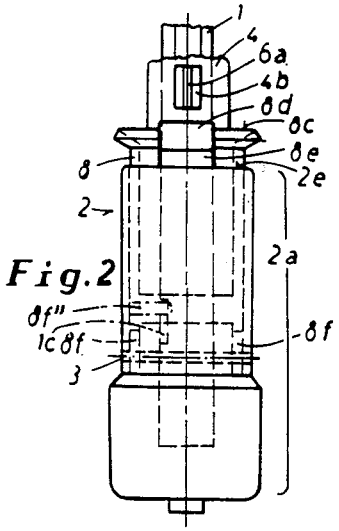
FIG. 2 is an elevation of the parts shown in FIG. 1, as seen turned through 90 degrees.

The sleeve 8 is preferably shaped in the form of a flared funnel 8*c*. The skid 8*d* conforms, at least to a certain extent, to this funnel shape and has a curved or otherwise inclined plane 8*e*, which bears, under the inherent tension of the springy segment 8*a*, and hence frictionally, against the edge 2*e* of the collar of the umbrella handle 2. This resilient frictional cooperation between the skid 8*d* and the edge 2*e* of the collar, which makes superfluous any separate spring element, is ensured by a restriction of the stroke of the sleeve 8, preferably by the crosspin 3, fixing the umbrella handle 2 onto the umbrella stick 1, also projecting through two elongate slots 8*f* which lie opposite to one another in the wall 8*g* of the sleeve. The pin-elongate hole guidance may, for example as indicated in FIG. 2 in dash-dot line, also be achieved by an elongate slot 1*c* in the umbrella stick 1 and a pin or other projection 8*f''* which engages in it so as to be able slide therealong, and which is seated on the sleeve 8. The arrangement may also be reversed. Through this restriction of the stroke of the sleeve 8 upwards, its position of readiness for release, and the contact, free of play, of the skid 8*d* against the edge 2*e* of the collar are ensured. The collar may alternatively be the edge of another part fixed to the stick.

Figure 6:
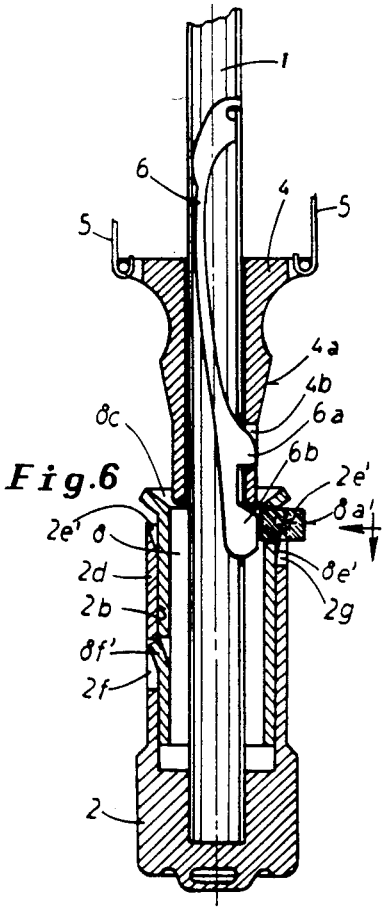
FIG. 6 is a section similar to FIG. 1, but of a further frame.

The stop or crosspin 3, 8*f* for the stroke of the sleeve 8 can naturally also be made in any other way, for example in the form of a tongue-elongate slot guidance 8*f'*, 2*f* as may be seen in FIG. 6, where the tongue 8*f'* or the slot 2*f* would be provided one on the stick on handle 2 and the other on the sleeve 8. In the case of an appropriately flexible constitution of the material catch and consequently the sleeve 8 may be mounted and dismounted more easily through simple snapping in or snapping out of the tongue 8*f'* in the slot 2*f*. The restriction of the stroke of the sleeve 8 upwards results through the contact of the tongue 8*f'* against the top end of the slot 2*f* if this is on the handle side in accordance with FIG. 6, or through contact of the tongue 8*f'* against the bottom end of the slot 2*f* if the latter is in the sleeve 8. This position, defining the position of readiness for release of the sleeve 8, may result from the action of pressure from the locking member 6 upon a secondary trigger which does not have the form of a lever swinging or turning radially similarly to the segment 8*a*, but the form of a slider which is movable radially in the sleeve 8. This slider, made as a knob 8a', bears at one end against the nose 6b of the locking member 6 and at the other end, by means of inclined surfaces 8e', 8e' flanking it at its sides, against an oblique bevel 2e fixed to the umbrella handle. The radial pressure of the locking member 6 upon the knob 8a' is consequently deflected into an upwardly directed axial pressure upon the sleeve 8. Upon actuation of the sleeve 8 downwards the knob 8a' slides into a slot 2g in the wall 2d, so that the inclined surfaces 8e', 8e' slide along the bevel 2e' and thereby steer the knob 8a' automatically radially against the locking member 6. In order to guarantee this control of the slider further, the inner part of the knob 8a' with the inclined surfaces 8e' is wider in cross-section than the slot 2g and the part of the knob 8a' able to slide therethrough.

OPERATION

If the sleeve in accordance with FIGS. 1 to 5 is shifted downwards (FIG. 3), the sleeve 8 slides into the umbrella handle 2 and into the annular channel 2c. Whilst doing so the slot 8f in the sleeve 8 shifts along the rigid crosspin 3, and the rounded inclined plane 8e on the skid 8d slides along the edge 2e of the collar so that the skid 8d, upon flexible bending of the segment 8a, moves radially towards the umbrella stick 1 and thereby simultaneously presses the oppositely lying nose 6b on the locking member 6 into the umbrella stick 1 until the nose 6a releases the slider 4 for manual or automatic opening of the umbrella. Upon letting go of the release trigger sleeve 8, because of the inherent restoring force of the springy segment 8a, and the curving displacement because of the funnel-shaped rounded inclined plane 8e on the skid 8d sliding against the edge 2e of the collar, without association with any special return spring which would otherwise be necessary, carries out its return stroke to the position shown in FIGS. 1 and 2. Should a user of the umbrella not have confidence in, or not be successful with the release of the slider through pressing in the release trigger axially in parallel with the stick (FIG. 3), the desired release is nevertheless made easy for him through the further possibility of operation by actuating the release mechanism through the exertion of pressure directed across the umbrella stick 1 against the skid 8d according to FIG. 4. In this case the skid 8d, which preferably also optically may be shaped conspicuously as a release button, is pressed in radially directly in the direction of the arrow 10 (FIG. 4) and thereby, through pressing in the nose 6b, disengages the locking member 6 from the slider 4. After letting go of the skid 8d, it returns, through the inherent spring force of the segment 8a, into the starting position again.

The pull-pressure or pressure-only possibilities of release of the slider locking member in accordance with FIGS. 5 and 6, are also available. In the case of the variant according to FIG. 5, it is merely that, instead of the nose 6b on the locking member 6, it is its lever arm 6'b, which is acted upon the skid 8d, and in consequence the locking nose 6'a is lifted out of the catch in the umbrella stick 1. In the case of the variant according to FIG. 6 there is merely effected a radial shifting of the knob 8a' instead of the radial swinging movement of the segment 8a.

The sleeve 8 may be guided against the cylindrical inner wall 2b of the handle 2 (FIG. 6) and/or in an annular channel 2c and/or against the umbrella stick 1 by means of a collar 8h (FIGS. 1 to 4). The springy segment 8a may also be fixed as a separate part to the sleeve 8 and have the form of a leaf spring running straight and in parallel with the umbrella stick 1, or of a curved leaf spring lying across or obliquely to the umbrella stick 1. If the segment 8a moulded directly onto the sleeve 8, say, because of a cross-section of the wall of the sleeve 8 which is too thin or too thick, has an inherent flexibility which is too low, with respect to the radial swinging, for bringing about, apart from its own return, also that of the sleeve 8, and for keeping the latter frictionally in the position of readiness for release in accordance with FIG. 1, the sleeve 8 may also be supported in the umbrella handle 2 by the force of its own return spring, which is not shown in detail.

I claim:

1. In an umbrella frame comprising a stick, a handle fixed to said stick, a slider slidable along said stick, a locking member arranged to lock said slider relative to said stick, and a trigger sleeve carried by said handle and arranged to have an operative axial movement relative to said stick from a first position to a second position, said trigger sleeve cooperating with said locking member whereby said operative axial movement of said trigger sleeve operates said locking member and thereby releases said slider for sliding movement on said stick; the improvement comprising: a pair of manually operated, integrated trigger means consisting of said axially movable trigger sleeve comprising a primary trigger and a radially, inwardly-operated spring element on said primary trigger which comprises a secondary trigger, said primary and secondary triggers projecting from said umbrella handle in a position adjacent said locking member, said secondary trigger being manually-displacable to engage and operate said locking member independently of said primary trigger being located to move radially to engage and operate said locking member, said radial movement resulting from said secondary trigger operative axial movement of said primary trigger.

2. The structure as claimed in claim 1 including an edge fixed relative to said stick, said secondary trigger comprising a displacable segment of said trigger sleeve, said displacable segment being arranged to cooperate with, and to be moved radially inwardly upon said fixed edge upon operative, axial movement of said trigger sleeve.

3. The structure as claimed in claim 2 wherein said secondary trigger has an inclined surface engaging the edge fixed relative to said stick and said secondary trigger is inherently resilient and operative to urge said trigger sleeve, through said inherent resilience, axially to an inoperative position.

4. The structure as claimed in claim 1 in which said trigger sleeve has a flared end into which said secondary trigger projects, said secondary trigger being shaped and conforming substantially to said flared end.

5. The structure as claimed in claim 1 including an edge fixed relative to said stick, said secondary trigger being radially, displacable relative to said trigger sleeve, said secondary trigger having first and second opposite sides, said first side having an inclined camming surface overlying and engagable with said fixed edge for displacing the secondary trigger toward said locking member, said second opposite side confronting said locking member and operating the locking member when said secondary trigger is displaced by said fixed edge.

6. The structure as claimed in claim 1 including means for limiting axial movement and orientation of said trigger sleeve relative to said stick, said means for limiting movement and orientation comprising a projection engaging in a slot, one of said projection and said slot being provided by said trigger sleeve and the other of said projection and said slot being provided by one of said handle and said stick.

* * * * *